US008074637B2

(12) United States Patent
Yamauchi

(10) Patent No.: US 8,074,637 B2
(45) Date of Patent: Dec. 13, 2011

(54) HIGH FREQUENCY HEATING APPARATUS HAVING A RANGE HOOD

(75) Inventor: Masato Yamauchi, Kyoto (JP)

(73) Assignee: Panasonic Corporation, Osaka (JP)

( * ) Notice: Subject to any disclaimer, the term of this patent is extended or adjusted under 35 U.S.C. 154(b) by 1085 days.

(21) Appl. No.: 11/976,226

(22) Filed: Oct. 23, 2007

(65) Prior Publication Data

US 2008/0105251 A1 May 8, 2008

Related U.S. Application Data

(63) Continuation-in-part of application No. 11/159,297, filed on Jun. 23, 2005, now abandoned.

(30) Foreign Application Priority Data

Jun. 23, 2004 (JP) ..... 2004-184730

(51) Int. Cl.
*F24F 7/00* (2006.01)
*F24F 13/00* (2006.01)

(52) U.S. Cl. ..... 126/299 R; 454/49; 126/299 D; 126/299 E

(58) Field of Classification Search ..... 454/67, 454/49; 126/299 D, 299 E, 299 F, 299 R; 219/757, 400, 494, 681, 685, 741
See application file for complete search history.

(56) References Cited

U.S. PATENT DOCUMENTS

| | | | | |
|---|---|---|---|---|
| 3,064,551 | A * | 11/1962 | Stalker | 126/299 D |
| 4,122,835 | A * | 10/1978 | Bowen et al. | 126/299 D |
| 4,143,646 | A | 3/1979 | Sampsel | |
| 4,146,016 | A * | 3/1979 | Bowen et al. | 126/299 D |
| 4,327,274 | A | 4/1982 | White et al. | |
| 4,418,261 | A | 11/1983 | Jailor et al. | |
| 4,682,580 | A * | 7/1987 | Fukumoto | 126/299 D |
| 4,886,046 | A | 12/1989 | Welch | |
| 5,042,458 | A | 8/1991 | Spencer et al. | |
| 5,981,929 | A | 11/1999 | Maeda et al. | |
| 6,222,171 | B1 | 4/2001 | Fukuda et al. | |
| 6,239,419 | B1 | 5/2001 | Kim | |
| 6,242,725 | B1 | 6/2001 | Murata et al. | |
| 6,291,809 | B1 | 9/2001 | Ha | |
| 6,335,521 | B1 | 1/2002 | Jeong et al. | |
| 7,022,958 | B2 | 4/2006 | Yamauchi et al. | |
| 7,049,567 | B2 | 5/2006 | Kim | |
| 7,098,432 | B2 | 8/2006 | Rew et al. | |
| 7,135,663 | B2 | 11/2006 | Kang | |
| 2005/0092746 | A1 | 5/2005 | Song et al. | |

FOREIGN PATENT DOCUMENTS

| | | | |
|---|---|---|---|
| EP | 940632 | A1 * | 9/1999 |
| EP | 940633 | A2 * | 9/1999 |
| JP | 2005077063 | | 3/2005 |

* cited by examiner

*Primary Examiner* — Steven B McAllister
*Assistant Examiner* — Brittany E Towns
(74) *Attorney, Agent, or Firm* — Bacon & Thomas, PLLC

(57) ABSTRACT

A high frequency heating apparatus with a range hood, which has an opening for exhausting air and a cover for closing the opening, includes a microcomputer control unit for controlling an automatic opening/closing operation of the cover, a control panel for setting an operation of the apparatus, a display unit for displaying the control status, and a detecting unit for detecting an exhaust direction of a blower. The exhaust direction of the blower can alternate between indoor circulation and outdoor ventilation and the control unit opens the cover only when the detected exhaust direction of the blower is the indoor circulation and the cooling unit is stopped, and the control unit closes the cover when the detected exhaust direction of the blower is the outdoor ventilation or the cooling unit operates.

4 Claims, 5 Drawing Sheets

HIGH FREQUENCY HEATING APPARATUS HAVING A RANGE HOOD

CROSS REFERENCE TO RELATED APPLICATION

This application is a continuation-in-part application of U.S. application Ser. No. 11/159,297 filed on Jun. 23, 2005 now abandoned.

FIELD OF THE INVENTION

The present invention relates to a high frequency heating apparatus having at its bottom a range hood for suctioning byproduct gas generated from a heating cooker below an apparatus main body to perform an indoor circulation mode and an outdoor ventilation mode, wherein the apparatus has an automatically openable cover to open or close an exhaust opening provided in an upper portion of the apparatus main body, the cover being opened only when a blower is in the indoor circulation mode.

BACKGROUND OF THE INVENTION

Conventionally, a high frequency heating apparatus with a range hood has an automatic cover that opens or closes automatically, and a gas flow changing mechanism for allowing a user to change a gas exhaust direction from a blower to circulate byproduct gas, which is generated from a heating cooker installed below an apparatus main body and suctioned into the range hood through the lower portion of the apparatus main body, in an indoor space via an exhaust opening provided in an upper front portion of the apparatus main body or to exhaust it outside through a top portion or a rear portion of the apparatus main body (see, for example, U.S. Pat. No. 5,981,929).

In the apparatus with the above configuration, the automatic cover for closing the exhaust opening provided in the upper front portion of the apparatus main body is opened to provide a passageway for an exhaust air or a suction air for cooling electric components of the apparatus when the high frequency heating apparatus (for example, a microwave oven) is in an heating operation. Besides, the cover is also opened when the blower is operating regardless of an exhaust direction of the blower.

In the conventional apparatus, however, the automatic cover is opened even when its open state is not necessary, for example, when the gas exhaust direction of the blower is set for outdoor ventilation. Furthermore, the automatic cover is also opened to provide an opening for intake or exhaustion of air for cooling the electric components of the microwave oven when the microwave oven is in a heating operation. Accordingly, since the cover is opened too frequently even when it need not be opened, the advantage of installing the automatic cover to improve the aesthetic feature of the microwave oven by reducing the opening area on the surface of the apparatus main body cannot be fully utilized.

SUMMARY OF THE INVENTION

It is, therefore, an object of the present invention to provide a high frequency heating apparatus having a range hood capable of preventing unnecessary operations of an automatic cover with a simple structure, to thereby reduce power consumption and improve the design features of the apparatus.

In accordance with a preferred embodiment of the present invention, there is provided a high frequency heating apparatus with a range hood having an opening for exhausting air and a cover for closing the opening, includes a heating chamber for accommodating an object to be heated therein, a heating unit for heating the object to be heated, a cooling unit for cooling the heating unit, a microcomputer control unit for controlling the heating unit and an automatic opening/closing operation of the cover, a control panel for setting an operation of the apparatus, a display unit for displaying the control status, and a detecting unit for detecting an exhaust direction of a blower, wherein the exhaust direction of the blower alternate between indoor circulation and outdoor ventilation and, the control unit opens the cover only when the detected exhaust direction of the blower is the indoor circulation and the cooling unit is stopped, and the control unit closes the cover when the detected exhaust direction of the blower is the outdoor ventilation or the cooling unit operates.

By providing the intake and the discharge openings in a main body top portion to improve the cooling efficiency even when the automatic cover in the upper front portion of the apparatus is closed, cool air in the vicinity of the apparatus main body can be suctioned into the apparatus without being affected by hot and humid byproduct gas generated from an underneath heating cooker. Accordingly, sufficient cooling effect can be obtained without having to open the automatic cover in a high frequency heating operation of the apparatus, and it is possible to keep the automatic cover closed in an outdoor ventilation mode where the automatic cover need not be opened. Consequently, the high-quality design features of the apparatus appearance can be maintained by allowing the automatic cover to be closed when its opening is unnecessary by using a simple structure. Moreover, power consumption can be reduced as well.

In the above configuration, the blower suctions byproduct gas generated from the heating cooker below the high frequency heating apparatus and exhausts it through the exhaust opening. Further, through the control panel, a user can change the exhaust direction of the blower for the indoor circulation and the outdoor ventilation. Further, the detecting unit outputs a detection signal only when the exhaust direction of the blower is set for a certain mode, e.g., outdoor ventilation mode. As a result, the control unit closes the cover when the exhaust direction of the blower is set for the outdoor ventilation and, thus, the opening of the cover is unnecessary. Therefore, the appearance of the apparatus can be improved and power consumption can be reduced.

The above described control unit has an option for opening or closing the cover and performs a control for closing the cover only when the exhaust direction of the blower is set for the outdoor ventilation. Therefore, the high-quality design features of the apparatus with the cover can be maintained even when the apparatus is operating in the outdoor ventilation mode. At the same time, reduction in power consumption is also possible.

The above described control unit detects the exhaust direction of the blower based on the detection signal from the detecting unit and the display unit displays the exhaust direction of the blower and an open or close status of the cover when the apparatus is initially powered on or the blower is operated. Therefore, the user can confirm the setting of the exhaust direction of the blower and the open/close status of the cover prior to starting the apparatus conveniently.

The above explained cooling unit is provided with intake openings through which room air is suctioned into the apparatus and discharge openings through which, after the room air is circulated in the apparatus, thus circulated air is discharged. Accordingly, the cover does not need to open when the cooling of the electric components is required.

BRIEF DESCRIPTION OF THE DRAWINGS

The above and other objects and features of the present invention will become apparent from the following description of preferred embodiments given in conjunction with the accompanying drawings, in which:

FIG. 4A shows a display unit indicating an indoor circulation mode and an open status of an automatic cover while

DETAILED DESCRIPTION OF PREFERRED EMBODIMENTS

Figure 1:
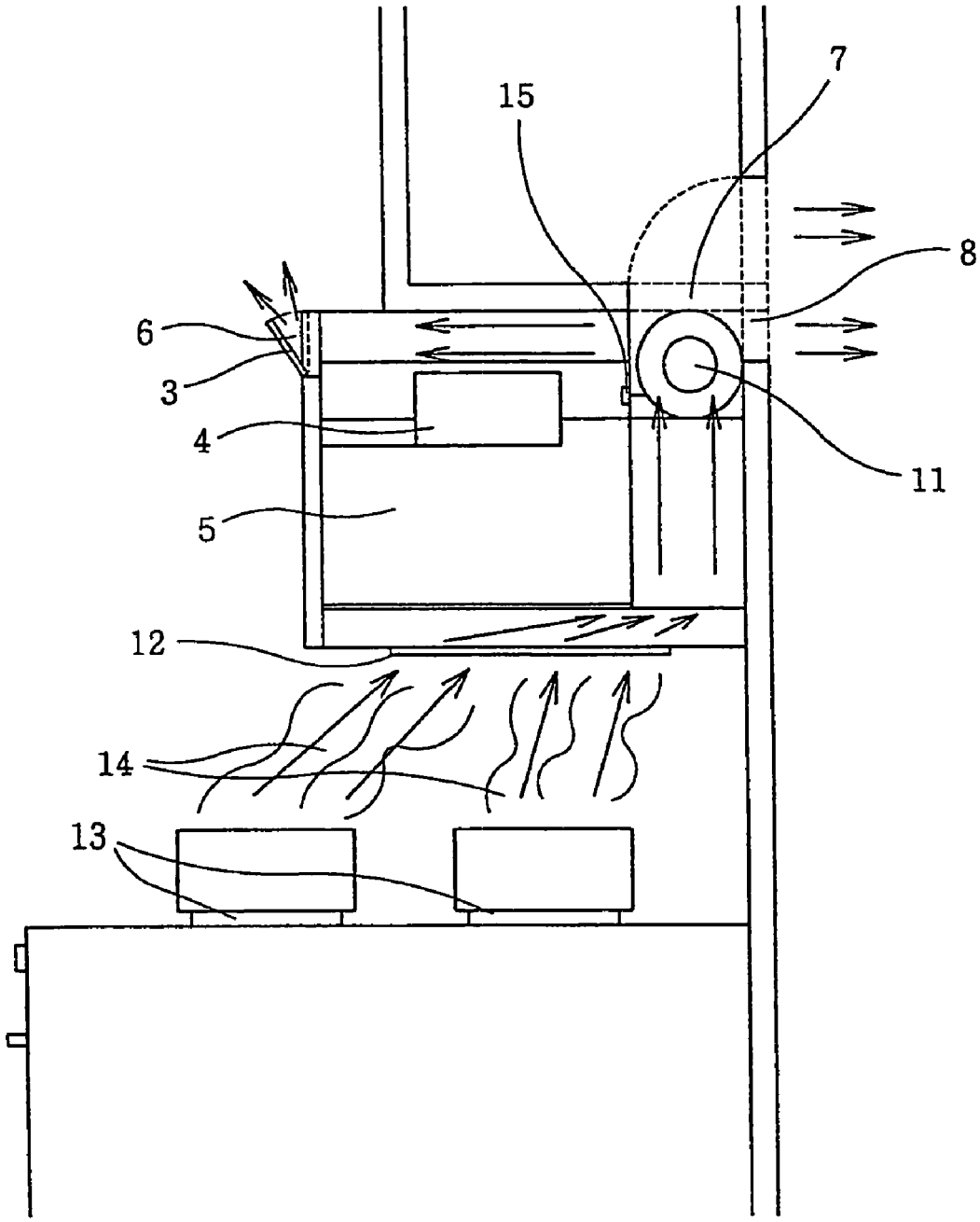
FIG. 1 shows a configuration of a high frequency heating apparatus with a range hood having a structure capable of changing a gas exhaust direction of a blower for indoor circulation or outdoor ventilation in accordance with a preferred embodiment of the present invention.

FIG. 1 illustrates a configuration of a high frequency heating apparatus with a range hood having an indoor circulation mode and an outdoor ventilation mode depending on the exhaust direction of a blower in accordance with a preferred embodiment of the present invention.

Figure 2A:
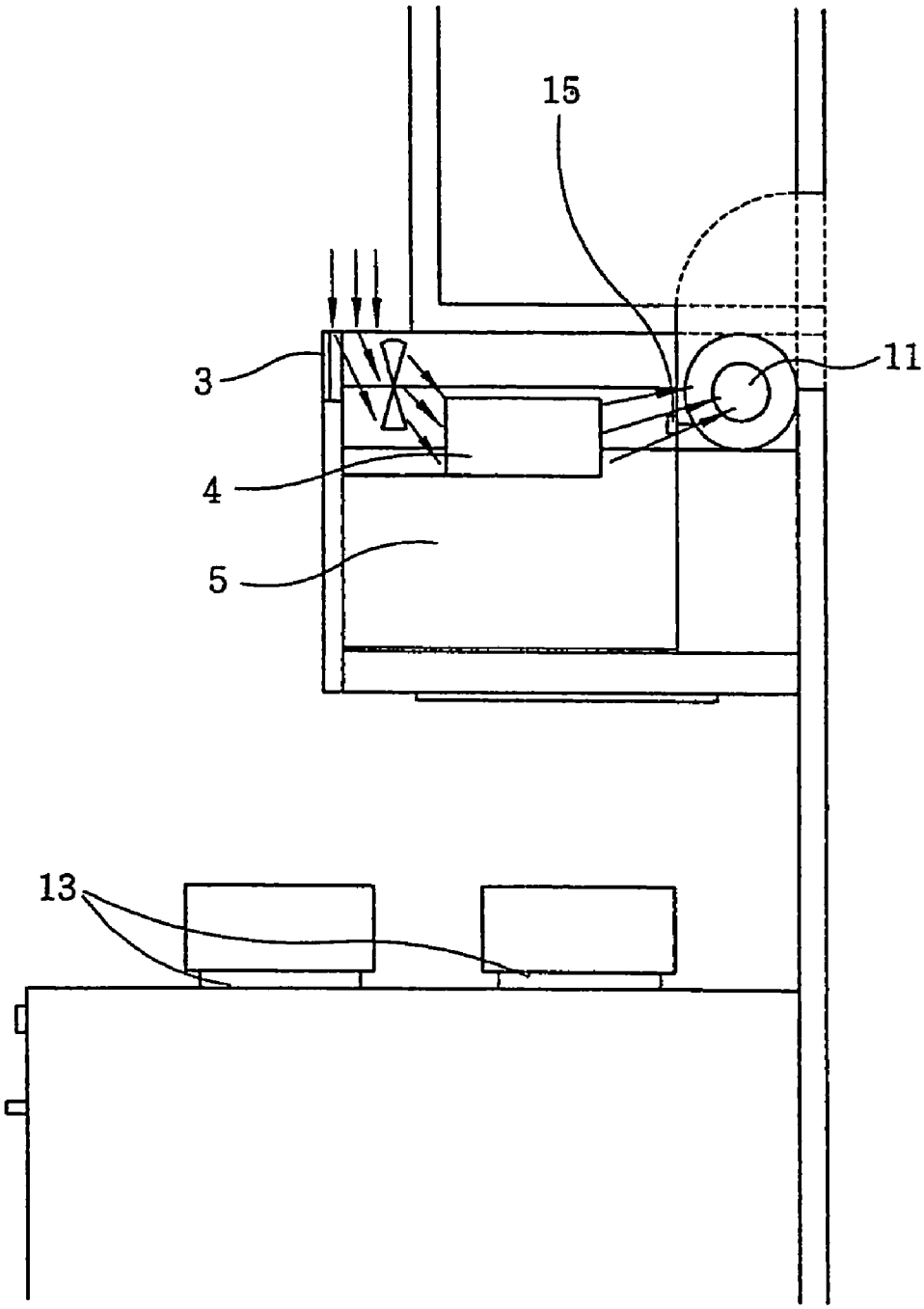
FIGS. 2A and 2B respectively provide a cross sectional view and a perspective configuration view to describe the cooling mechanism of a high frequency heating apparatus having a range hood with intake and discharge openings for cooling electric components in accordance with a preferred embodiment of the present invention, the intake and the discharge openings being provided in a top surface portion of the apparatus.
Figure 2B:
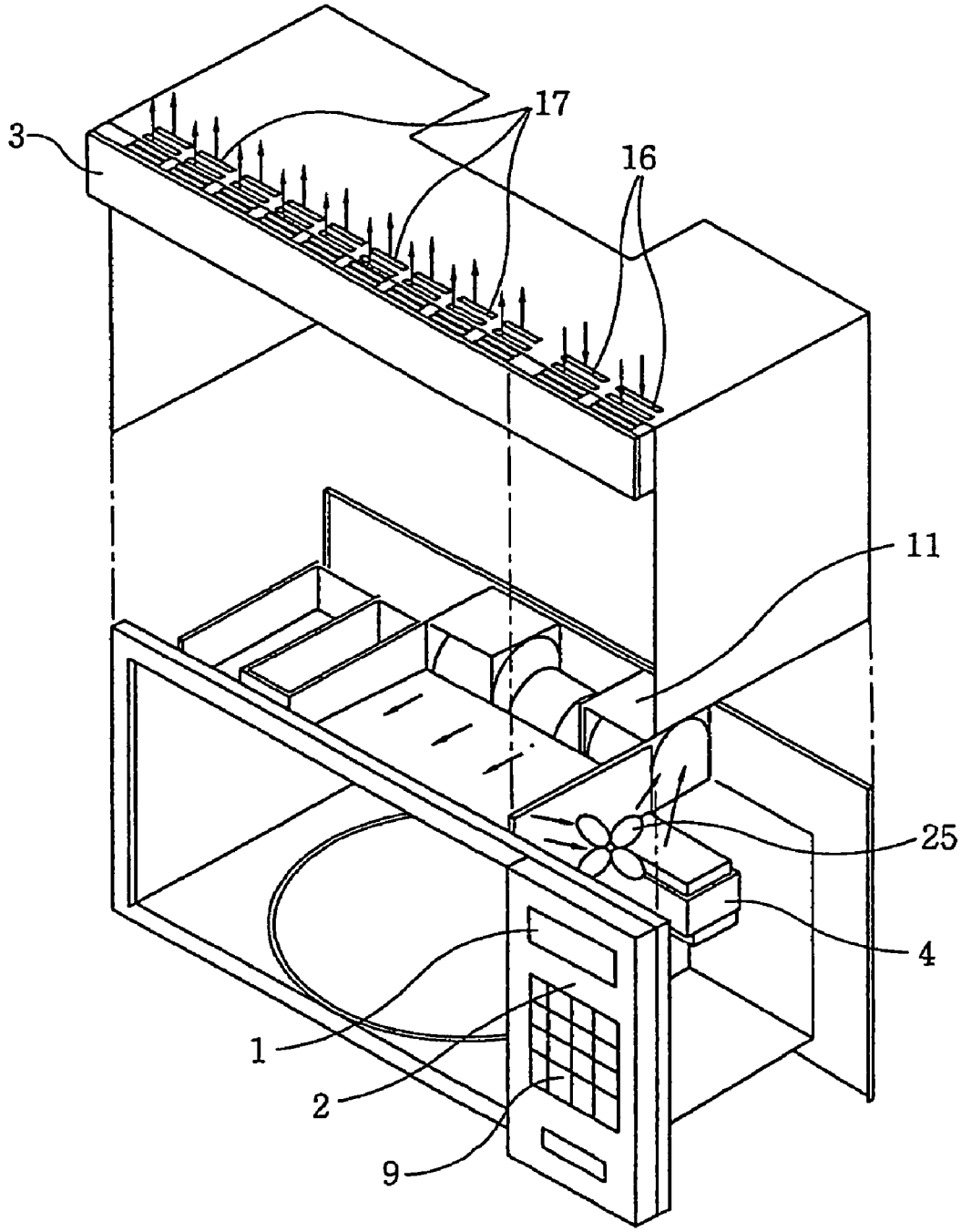

As shown therein, the high frequency heating apparatus includes blower 11, automatic cover 3 that opens and closes automatically, exhaust opening 6 for indoor circulation, upper exhaust opening 7 provided in a main body upper portion for outdoor ventilation, rear exhaust opening 8 provided in a main body rear portion for outdoor ventilation, suction opening 12 provided in a main body lower portion, heating chamber 5, heating unit 4, display unit 1 (see FIG. 2B), microcomputer control unit 2 (see FIG. 2B), control panel 9 (see FIG. 2B), detection switch (detecting unit) 15 and cooling fan 25 (see FIG. 2B)

FIGS. 2A and 2B show suction and exhaust flow of cooling air for cooling self-heating components with an automatic cover closed when the high frequency heating apparatus is in a heating operation. FIGS. 2A and 2B are a cross sectional view and a perspective configuration view illustrating a cooling mechanism, respectively.

Figure 3A:
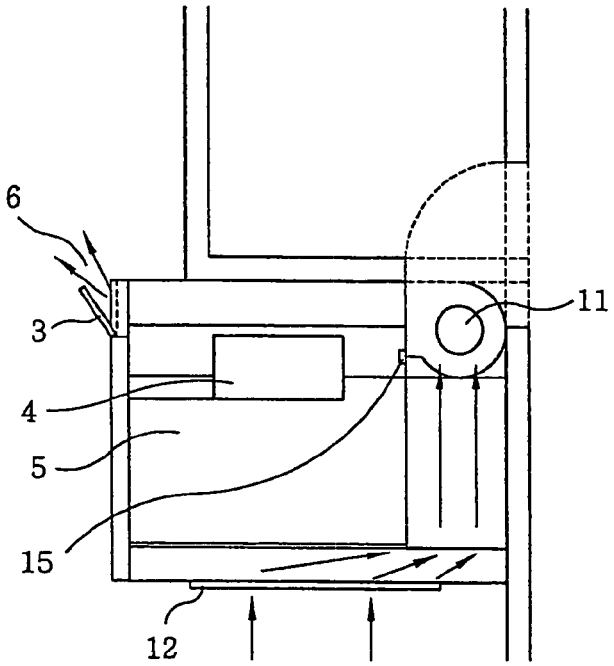
FIG. 3A presents a cross sectional view to show a gas exhaust direction from a blower in an indoor circulation mode, and FIGS. 3B and 3C respectively depict cross sectional views to show a gas exhaust direction of the blower in an outdoor ventilation mode through an upper exhaust opening and through a rear exhaust opening in accordance with a preferred embodiment of the present invention.
Figure 3B:
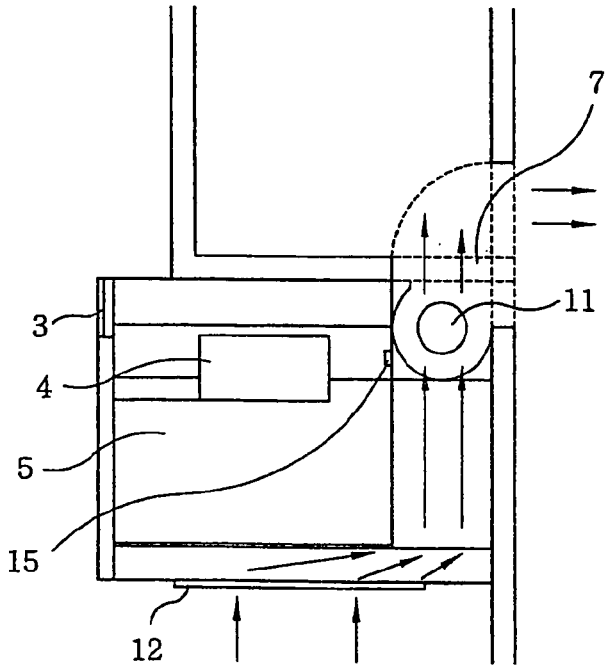
Figure 3C:
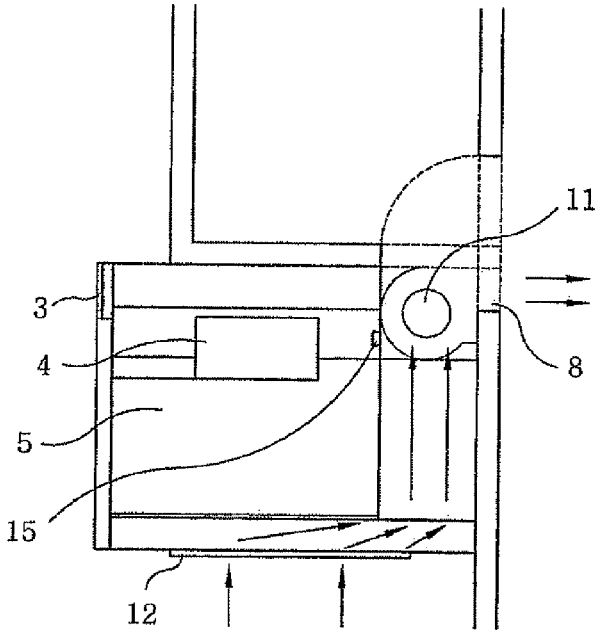

FIGS. 3A to 3C describe an internal configuration of the high frequency heating apparatus with a range hood capable of closing automatic cover 3 by motor driving based on a detection of detection switch 15 when the exhaust direction of blower 11 is set for a certain mode (i.e., an indoor circulation mode). Specifically, FIG. 3A is a cross sectional view showing an exhaust direction of blower 11 in an indoor circulation mode and FIGS. 3B and 3C respectively depict cross sectional views showing an exhaust direction of blower 11 in an outdoor ventilation mode through upper exhaust opening 7 and through rear exhaust opening 8 in accordance with the preferred embodiment of the present invention.

Figure 4A:
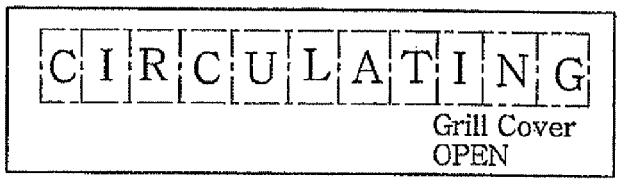
Figure 4B:
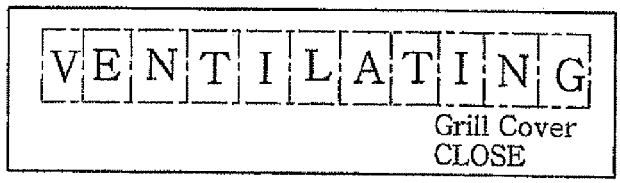
FIG. 4B illustrates a display unit indicating an outdoor ventilation mode and a close status of the automatic cover.

FIGS. 4A and 4B illustrate examples of display unit 1 indicating an exhaust direction of blower 11 and an open/close status of automatic cover 3 in accordance with the preferred embodiment of the present invention.

Returning to FIG. 1, the high frequency heating apparatus with the range hood in accordance with the preferred embodiment of the present invention has an air flow mechanism for suctioning byproduct gas 14, which is generated from heating cooker 13 located below an apparatus main body, through suction opening 12 provided in a main body lower portion to re-circulate the suctioned byproduct gas through front exhaust opening 6 in a main body front portion or to exhaust it outside through upper exhaust opening 7 in the main body upper portion and/or rear exhaust opening 8 in the main body rear portion by the operation of blower 11.

Meanwhile, referring to FIGS. 2A to 2C, in a high frequency heating operation performed independently from blower 11, automatic cover 3 is closed, and, instead, there are provided intake openings 16 and discharge openings 17 in a top surface portion of the apparatus main body to allow an air flow for cooling self-heating components.

Below, the operation and function of a high frequency heating apparatus with a range hood having the above configuration will be described.

The cooling process for the heating components in the high frequency heating operation will now be described with reference to FIGS. 2A and 2B while the cooling fan is not driven. Blower 11 draws byproduct gas 14, which is generated from heating cooker 13 located below an apparatus main body, through suction opening 12 provided in the main body lower portion.

As illustrated in FIGS. 2A and 2B, the high frequency heating apparatus is provided with intake openings 16 and discharge openings 17 for use in cooling self-heating components, wherein the intake and discharge openings 16 and 17 are provided in an apparatus main body's top surface portion which is hidden from view after installation in order not to be affected by heat from the underneath heating cooker 13. Specifically, when the self-heating components need to be cooled during the operation of the high frequency heating apparatus, the room air is drawn into the apparatus through intake openings 16 by cooling fan 25 to cool the self-heating components. Thereafter, thus circulated room air is discharged from the apparatus via discharge openings 17. Therefore, cover 3 can be maintained closed during an operation of the apparatus in which the opening of the cover is unnecessary. Consequently, the appearance of the apparatus can be improved and power consumption can be reduced when the apparatus is operating.

In other words, by providing intake openings 16 and discharge openings 17 in the top surface of the apparatus main body to cool self-heating components when the high frequency heating apparatus is in a heating operation, a cooling effect can be obtained without having to open cover 3. Therefore, it is possible to realize a high frequency heating apparatus with a range hood in which cover 3 is closed in an outdoor ventilation mode.

Further, as shown in FIGS. 3A to 3C, detecting unit 15 for detecting an exhaust direction of blower 11 is installed at a structure near blower 11 when blower 11 is mounted in the apparatus main body. Detecting unit 15 is configured in such a manner as to transmit a weak electric signal to control unit 2 to open cover 3 automatically only when it detects the exhaust direction of blower 11 is set for indoor circulation. Therefore, a control for selectively opening automatic cover 3 can be performed with a simple mechanism.

FIG. 3A shows that cover 3 is opened only when the detected exhaust direction of blower 11 is the indoor circulation mode and cooling fan 25 does not operate. Cover 3 is closed when the detected exhaust direction of blower 11 is the outdoor ventilation regardless of whether cooling fan 25 operates or not. If cooling fan 25 operates to cool the self-heating components and the detected exhaust direction of blower 11 is the indoor circulation mode, control unit 2 controls cover 3 to be maintained closed. In this case, byproduct gas 14 suctioned by blower 11 is re-circulated through discharge openings 17 instead of front exhaust opening 6. Accordingly, both the air used for cooling the self-heating components and byproduct gas 14 to be re-circulated are discharged through discharge openings 17 when the cooling process and the indoor circulation are simultaneously performed.

Moreover, as shown in FIGS. 4A and 4B, display unit 1 displays the exhaust direction of blower 11 and the open/close status of automatic cover 3 when the apparatus is first powered on or blower 11 is operated. Thus, a user can confirm the setting of the blower and the on/off status of the cover, finding the setup state of the apparatus or its operational failure conveniently.

As described above, the high frequency heating apparatus with the range hood in accordance with the present invention can reduce power consumption by minimizing the motor driving with a simple structure. Therefore, it can be applied to various equipments having a cover for opening or closing an exhaust opening for a blower.

In accordance with the present invention, it is possible to obtain a sufficient cooling effect for cooling self-heating components during the microwave oven's heating operation even when the exhaust direction of the blower is set for outdoor ventilation and, thus, the automatic cover is closed. Accordingly, the automatic cover is not opened unnecessarily, so that the aesthetic features of the apparatus can be improved considerably while saving energy as well.

In the embodiment of the present invention, the automatic cover is opened only when the detected exhaust direction of blower is the indoor circulation mode and the cooling unit does not operate. However, the automatic cover can be configured to be opened only when the detected exhaust direction of blower is the indoor circulation mode and the cooling unit operates, and closed if otherwise. In this case also, the automatic cover is not opened unnecessarily, so that the aesthetic features of the apparatus can be improved considerably while saving energy as well.

While the invention has been shown and described with respect to the preferred embodiments, it will be understood by those skilled in the art that various changes and modifications may be made without departing from the spirit and scope of the invention as defined in the following claims.

What is claimed is:

1. A high frequency heating apparatus with a range hood having an opening for exhausting air and a cover for closing the opening, comprising:

a heating chamber for accommodating an object to be heated therein;

a heating unit for heating the object to be heated;

a cooling unit for cooling the heating unit;

a microcomputer control unit for controlling the heating unit and an automatic opening/closing operation of the cover;

a control panel for setting an operation of the apparatus;

a display unit for displaying a control status; and a detecting unit for detecting an exhaust direction of a blower, wherein the exhaust direction of the blower alternates between indoor circulation and outdoor ventilation;

wherein the control unit opens the cover only when the detected exhaust direction of the blower is the indoor circulation and the cooling unit is stopped; and wherein the control unit closes the cover when the detected exhaust direction of the blower is the outdoor ventilation or the cooling unit operates.

2. The apparatus of claim 1, wherein the control unit detects the exhaust direction of the blower based on the detection signal from the detecting unit and the display unit displays the exhaust direction of the blower and an open or close status of the cover when the apparatus is initially energized or the blower is operated.

3. The apparatus of claim 1, wherein the cooling unit is provided with intake openings through which room air is suctioned into the apparatus and discharge openings through which, after the room air is circulated in the apparatus, thus circulated air is discharged from the apparatus.

4. The apparatus of claim 3, wherein when the detected exhaust direction of the blower is the indoor circulation and the cooling unit operates, air suctioned by the blower is discharged through the discharge openings.

* * * * *